US007923943B2

(12) United States Patent
Peker et al.

(10) Patent No.: US 7,923,943 B2
(45) Date of Patent: Apr. 12, 2011

(54) SECONDARY SIDE POST REGULATION FOR LED BACKLIGHTING

(75) Inventors: Arkadiy Peker, New Hyde Park, NY (US); Dror Korcharz, Bat Yam, IL (US)

(73) Assignee: Microsemi Corp.—Analog Mixed Signal Group Ltd., Hod Hasharon (IL)

( * ) Notice: Subject to any disclaimer, the term of this patent is extended or adjusted under 35 U.S.C. 154(b) by 1129 days.

(21) Appl. No.: 11/621,160

(22) Filed: Jan. 9, 2007

(65) Prior Publication Data

US 2007/0159421 A1 Jul. 12, 2007

Related U.S. Application Data

(60) Provisional application No. 60/757,466, filed on Jan. 10, 2006.

(51) Int. Cl.
*H05B 37/02* (2006.01)

(52) U.S. Cl. ..... 315/312; 315/320; 315/257; 315/291; 345/82

(58) Field of Classification Search ..... 315/291, 315/299, 300, 307, 312, 362, 209 R, 224, 315/250, 254, 257, 320; 363/20, 21.1, 21.12, 363/21.18; 345/102, 82, 83; 323/282–285
See application file for complete search history.

(56) References Cited

U.S. PATENT DOCUMENTS

| | | | | |
|---|---|---|---|---|
| 5,920,466 | A | 7/1999 | Hirahara | |
| 5,949,658 | A | 9/1999 | Thottuvelil et al. | |
| 6,369,525 | B1 | 4/2002 | Chang et al. | |
| 6,504,267 | B1 | 1/2003 | Giannopoulos | |
| 6,507,159 | B2 | 1/2003 | Muthu | |
| 6,529,182 | B1 | 3/2003 | Burton | |
| 6,621,235 | B2 | 9/2003 | Chang | |
| 6,888,529 | B2 * | 5/2005 | Bruning et al. | 345/102 |
| 7,202,608 | B2 * | 4/2007 | Robinson et al. | 315/224 |
| 7,557,521 | B2 * | 7/2009 | Lys | 315/294 |
| 2003/0025120 | A1 | 2/2003 | Chang | |
| 2004/0251854 | A1 * | 12/2004 | Matsuda et al. | 315/291 |
| 2006/0022607 | A1 | 2/2006 | Hsu | |
| 2006/0119185 | A1 | 6/2006 | Steigerwald et al. | |
| 2006/0208719 | A1 | 9/2006 | Librizzi | |
| 2006/0234779 | A1 | 10/2006 | Haener et al. | |

FOREIGN PATENT DOCUMENTS

EP 0698959 B1 2/2000

OTHER PUBLICATIONS

Texas Instruments Application Note "A Revolutionary Power Management Solution for Highly Efficient, Multiple Output Applications", published 2001, Dallas, Texas.

* cited by examiner

*Primary Examiner* — Jacob Y Choi
*Assistant Examiner* — Ephrem Alemu
(74) *Attorney, Agent, or Firm* — Simon Kahn

(57) ABSTRACT

A secondary side post regulator arrangement for a plurality of LED strings. For each secondary winding, a first electronically controlled switch is provided arranged to control the power output, and a LED string is connected thereto. A second electronically controlled switch is further connected in series with the LED string, arranged to receive a PWM signal, thereby pulsing current through the LED string. A current sensing element is further provided outputting a voltage representation of the current through the LED string, and a synchronized sampling circuit is provided arranged to sample the voltage representation during the on period of the second electronically controlled switch. The sampled and held voltage representation is compared with a reference signal and fed back to control the first electronically controlled switch. The voltage output associated with each secondary winding is controlled, responsive to the reference voltage.

33 Claims, 4 Drawing Sheets

SECONDARY SIDE POST REGULATION FOR LED BACKLIGHTING

CROSS-REFERENCE TO RELATED APPLICATION

This application claims priority from provisional patent application Ser. No. 60/757,466 filed Jan. 10, 2006, entitled "Variable Voltage Source for LED Backlighting", the entire contents of which is incorporated herein by reference.

BACKGROUND OF THE INVENTION

The present invention relates to the field of LED based lighting and more particularly to a constant current source for a series LED string having a voltage control feedback.

Light emitting diodes (LEDs) and in particular high intensity LED strings are rapidly coming into wide use. High intensity LEDs are sometimes called high power LEDs, high brightness LEDs, high current LEDs or super luminescent LEDs and are useful in a number of applications including backlighting for liquid crystal display (LCD) based monitors and televisions, collectively hereinafter referred to as a monitor. In a large LCD monitor typically the high intensity LEDs are supplied in a string of serially connected high intensity LEDs, thus sharing a common current. The term LED as used herein is meant to include any LED used to generate a light output and is meant to include, without limitation, any and all of high intensity LEDs, high power LEDs, high brightness LEDs, high current LEDs and super luminescent LEDs.

In order supply a white backlight for the monitor one of two basic techniques are commonly used. In a first technique one or more strings of "white" LEDs are utilized, the white LEDs typically comprising a blue LED with a phosphor which absorbs the blue light emitted by the LED and emits a white light. In a second technique individual strings of colored LEDs are placed in proximity so that in combination their light is seen a white light. Often, two strings of green LEDs are utilized to balance one string each of red and blue LEDs.

In either of the two techniques, the strings of LEDs are typically located at one end, one side, or in the back of the monitor, the light being diffused to appear behind the LCD by a diffuser. In the case of colored LEDs, a further mixer is required, to ensure that the light of the colored LEDs are not viewed separately, but are rather mixed to give a white light. The mixer may be integrated within the diffuser. The white point of the light is an important factor to control, and much effort in design in manufacturing is centered on the need for a correct white point.

Each of the colored LED strings is typically intensity controlled by both amplitude modulation (AM) and pulse width modulation (PWM) to achieve an overall fixed perceived luminance. AM is typically used to set the white point produced by the disparate colored LED strings by setting the constant current flow through the diode string to a value achieved as part of a white point calibration process and PWM is typically used to variably control the overall luminance, or brightness, of the monitor without affecting the white point balance. Thus the current, when pulsed, is held constant to maintain the white point among the disparate colored LED strings, and the PWM duty cycle is controlled to dim or brighten the backlight. The PWM may be further adjusted during operation to correct for any color imbalance caused by temperature or aging of the colored LEDs.

Each of the disparate colored LED strings has a voltage requirement associated with the forward drop and number of colored high intensity LEDs of the LED string. In one prior art method, a linear regulator per LED string is used to maintain a constant current. Unfortunately, excess power dissipation in the regulator results in an overall inefficient circuit, particularly if the voltage is unregulated and varies over a wide range.

U.S. Pat. No. 6,369,525 issued Apr. 9, 2002 to Chang et al, the entire contents of which is incorporated herein by reference, is addressed to a secondary side post regulator for use with LED arrays. The circuit comprises a plurality of secondary controllers, each associated with a particular secondary winding and configured to control a flow of current to its respective LED array. Unfortunately, Chang does not teach the use of PWM to achieve an overall luminance in cooperation with the secondary side post regulator controllers. The use of PWM leads to significant voltage output transients which results in distorted LED current waveforms causing significant inaccuracy in color and luminance of LCD monitors.

There is thus a long felt need for a voltage controlled source, preferably implemented in a secondary side post regulator, which is adapted for use with PWM switched current loads.

SUMMARY OF THE INVENTION

Accordingly, it is a principal object of the present invention to overcome the disadvantages of prior art. This is provided in the present invention by a secondary side post regulator arrangement for a plurality of LED strings. For each secondary winding of the secondary side post regulator, a first electronically controlled switch is provided arranged to control the power output, and a LED string is connected thereto. A second electronically controlled switch is further connected in series with the LED string, arranged to receive a PWM signal, thereby pulsing current through the LED string. A current sensing element is further provided outputting a voltage representation of the current through the LED string, and a synchronized sampler is provided arranged to sample the voltage representation during the on period of the second electronically controlled switch. The sampled and held voltage representation is compared with a reference signal and fed back to control the first electronically controlled switch. Thus, the voltage output associated with each secondary winding is controlled, responsive to the reference voltage, and is not a function of the pulsed current through the LED string.

Preferably the operation of the plurality of voltage sources and the PWM controller are synchronized.

The invention provides for a powering arrangement for a plurality of light emitting diode (LED) strings, the powering arrangement comprising: a transformer exhibiting a primary winding and a plurality of secondary windings coupled to the primary winding; a first plurality of electronically controlled switches, each of the first plurality of electronically controlled switches associated with a particular one of the plurality of secondary windings; a plurality of LED strings, each of the plurality of LED strings associated with, and arranged to receive power from, a particular one of the plurality of secondary windings responsive to the respective first electronically controlled switch; a second plurality of electronically controlled switches, each of the second plurality of electronically controlled switches arranged in series with a particular one of the plurality of LED strings and operable to pulseably enable the flow of current through the particular LED string; a plurality of synchronized samplers, each of the plurality of synchronized samplers in communication with a particular one of the plurality of LED strings and arranged to sample the pulseably enabled current flow and output a sampled representation; and a plurality of feedback circuits each associated with a particular one of the plurality of synchronized samplers, each of the plurality of feedback circuits operable to control a respective one of the first electronically controlled switches responsive to the respective sampled representation.

In one embodiment at least one of the plurality of synchronized samplers comprises a current sensing element arranged to provide a voltage representation of the current through the particular one of the plurality of LED strings. In one further embodiment the at least one of the plurality of synchronized samplers comprises a synchronized sampling circuit in communication with the current sensing element and operable to sample the voltage representation during the pulseably enabled current flow. In one yet further embodiment the synchronized sampling circuit comprises one of a sample and hold circuit and an analog to digital converter. In another further embodiment the current sensing element comprises one of a resistor and a field effect transistor.

In one embodiment the powering arrangement further comprises a plurality of reference voltages, each of the plurality of feedback circuits being further associated with, and responsive to, a particular one of the plurality of reference voltages, the control of the respective one of the first electronically controlled switches being a function of the respective reference voltage. In one further embodiment the plurality of reference voltages are variable. In another further embodiment each of the plurality of feedback circuits comprises a comparing circuit arranged to: receive the associated reference voltage and the sampled representation; and output a compared signal responsive to the difference between the received reference voltage and the received sampled representation, the control of the respective one of the first electronically controlled switch being responsive to the compared signal. In another further embodiment the powering arrangement further comprises a control circuit operable to set the plurality of reference voltages so as to bring each of the plurality of LED strings to a pre-determined luminance.

In yet another further embodiment the powering arrangement further comprises a control circuit operable to set the plurality of reference voltages so as to bring each of the plurality of LED strings to produce a pre-determined white point. In one yet further, further embodiment the powering arrangement further comprises a memory associated with the control circuitry, the memory having stored thereon an initial calibration white point setting, the plurality of reference voltages being responsive to the stored initial calibration white point setting. In another yet further, further embodiment the control circuitry further comprises a means for receiving a temperature input, the control circuitry being operable to modify at least one of the plurality of reference voltages responsive to the received temperature input. In yet another further, further embodiment the control circuitry further comprises a means for receiving a color sensor input, the control being operable to modify at least one of the plurality of reference voltages responsive to the received color sensor input so as to maintain the predetermined white point.

In one embodiment the powering arrangement further comprises a plurality of pulse width modulation controllers, each of the second plurality of electronically controlled switches pulseably enabling the current flow responsive to a particular one of the plurality of pulse width modulation controllers. In one further embodiment the powering arrangement further comprises a control circuitry, each of the pulse width modulation controllers being responsive to the control circuitry to modify the luminance of each of plurality of LED strings. In another further embodiment the powering arrangement further comprises a saw tooth voltage source, each of the plurality of pulse width modulation controllers being responsive to the saw tooth voltage source. Preferably, each of the plurality of feedback circuits is further responsive to the saw tooth voltage source.

In one embodiment the powering arrangement further comprises a plurality of one way electronic valves, each of the plurality of one way electronic valves being associated with a particular one of the plurality of secondary windings and in communication with the respective first electronically controlled switch. In another embodiment the control of the respective one of the first electronically controlled switches controls the voltage of the power received by the respective LED string.

The invention also provides for a powering arrangement comprising: a plurality of DC/DC converters receiving power from a common power source, each of the plurality of DC/DC converters comprising a first electronically controlled switch; a plurality of second electronically controlled switches, each of the second plurality of electronically controlled switches associated with, and arranged in series with, the output of a particular one of the plurality of DC/DC converters and operable to pulseably enable the flow of current sourced from the particular DC/DC converter through a respective load; a plurality of synchronized samplers, each of the plurality of synchronized samplers associated with a particular one of the plurality of second electronically controlled switches and arranged to sample the pulseably enabled current flow and output a sampled representation; and a plurality of feedback circuits each associated with a particular one of the plurality of synchronized samplers, each of the plurality of feedback circuits operable to control a respective one of the first electronically controlled switches responsive to the respective sampled representation.

In one embodiment the control of the respective one of the first electronically controlled switches thereby controls the output of the respective DC/DC converter. In another embodiment the powering arrangement further comprises a plurality of reference voltages, each of the plurality of feedback circuits being further associated with, and responsive to, a particular one of the plurality of reference voltages, the control of the respective one of the first electronically controlled switches being a function of the respective reference voltage. In one further embodiment the plurality of reference voltages are variable. In another further embodiment each of the plurality of feedback circuits comprises a comparing circuit arranged to: receive the associated reference voltage and the sampled representation; and output a compared signal responsive to the difference between the received reference voltage and the received sampled representation, the control of the respective one of the first electronically controlled switch being responsive to the compared signal.

In one embodiment each of the plurality of DC/DC converters is arranged to power a LED string, the load being constituted of an LED string. In another embodiment the powering arrangement further comprises a plurality of pulse width modulation controllers, each of the second plurality of electronically controlled switches pulseably enabling the current flow responsive to a particular one of the plurality of pulse width modulation controllers.

The invention also provides for a powering arrangement for use with a plurality of secondary side regulators enabling intensity control of an LED backlight by an adjustable pulse width modulation, the powering arrangement comprising: a plurality of electronically controlled switches, each of the plurality of electronically controlled switches associated with, and arranged for connection in series with, the output of a particular one of a plurality of secondary side regulators and operable to pulseably enable the flow of current through a respective load; a plurality of synchronized samplers, each of the plurality of synchronized samplers associated with a particular one of the plurality of electronically controlled switches and arranged to sample the pulseably enabled current flow and output a sampled representation; and a plurality of feedback circuits each associated with a particular one of the plurality of synchronized samplers, each of the plurality of feedback circuits being configured for control of the associated particular secondary side regulator responsive to the respective sampled representation.

In one embodiment the powering arrangement further comprises the plurality of secondary side regulators, the plurality of secondary side regulators receiving power from a common power source. In another embodiment the powering arrangement further comprises a plurality of reference voltages, each of the plurality of feedback circuits being further associated with, and responsive to, a particular one of the plurality of reference voltages, the control of the associated particular secondary side regulator being a function of the respective reference voltage. Preferably, the plurality of reference voltages are variable.

In one embodiment each of the plurality of feedback circuits comprises a comparing circuit arranged to: receive the associated reference voltage and the sampled representation; and output a compared signal responsive to the difference between the received reference voltage and the received sampled representation, the control of the associated particular secondary side regulator being responsive to the compared signal. In another embodiment the powering arrangement further comprises a plurality of pulse width modulation controllers, each of the second plurality of electronically controlled switches pulseably enabling the current flow responsive to a particular one of the plurality of pulse width modulation controllers.

The invention also provides for a method of powering for a plurality of LED strings, the method comprising: providing a secondary side controller; providing a LED string associated with the provided secondary side controller; pulseably enabling current flow through the associated provided LED string; sampling the pulseably enabled current flow during the pulseably enabled current flow; and feeding back a function of the sampled pulseably enabled current flow to the provided secondary side controller.

In one embodiment the method further comprises: receiving a reference voltage, the fed back function back being responsive to the received reference voltage. Preferably, the reference voltage is variable. In another embodiment the stage of feeding back a function comprises: receiving a reference voltage; comparing the received reference voltage and sampled pulseably enabled current flow; and outputting a comparing signal responsive to the difference between the received reference voltage and the received sampled representation.

The invention also provides for a powering arrangement for use with a plurality of secondary side regulators enabling intensity control of an LED backlight by an adjustable pulse width modulation, the powering arrangement comprising: a plurality of synchronized samplers, each of the plurality of synchronized samplers arranged to sample a pulseably enabled current flow and output a sampled representation; and a plurality of feedback circuits each associated with a particular one of the plurality of synchronized samplers, each of the plurality of feedback circuits being configured for control of an associated particular secondary side regulator responsive to the sampled representation.

Additional features and advantages of the invention will become apparent from the following drawings and description.

BRIEF DESCRIPTION OF THE DRAWINGS

For a better understanding of the invention and to show how the same may be carried into effect, reference will now be made, purely by way of example, to the accompanying drawings in which like numerals designate corresponding elements or sections throughout.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DETAILED DESCRIPTION OF PREFERRED EMBODIMENTS

Figure 1:
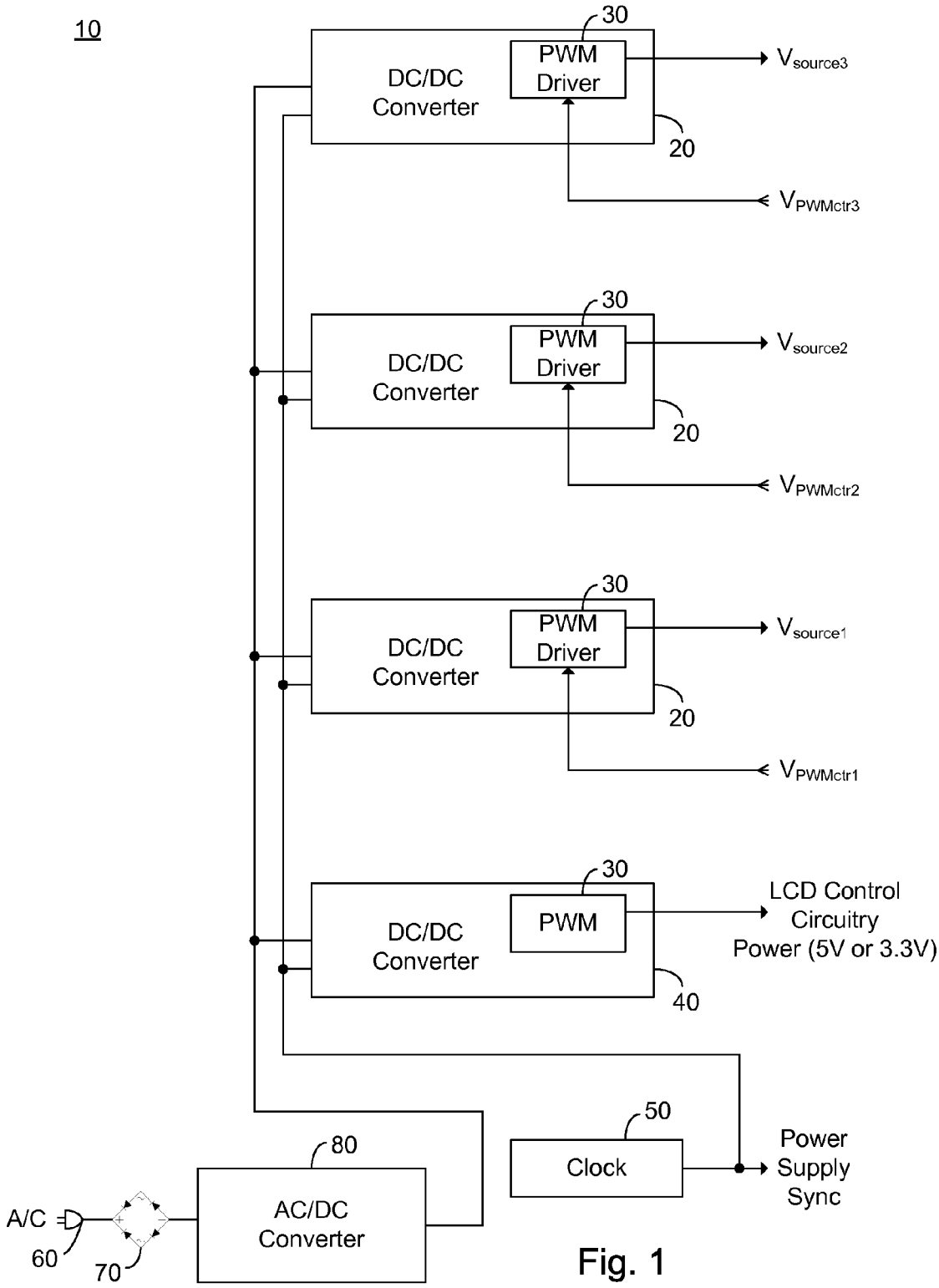
FIG. 1 illustrates a high level schematic diagram of an embodiment of a plurality of voltage sources comprising a plurality of DC/DC converters, each of the DC/DC converters receiving a PWM control responsive to the pulsed constant current flow in a respective LED string in accordance with a principle of the invention.

The present embodiments enable a secondary side post regulator arrangement for a plurality of LED strings. For each secondary winding of the secondary side post regulator, a first electronically controlled switch is provided arranged to control the power output, and a LED string is connected thereto. A second electronically controlled switch is further connected in series with the LED string, arranged to receive a PWM signal, thereby pulsing current through the LED string. A current sensing element is further provided outputting a voltage representation of the current through the LED string, and a synchronized sampler is provided arranged to sample the voltage representation during the on period of the second electronically controlled switch. The sampled and held voltage representation is compared with a reference signal and fed back to control the first electronically controlled switch.

Thus, the voltage output associated with each secondary winding is controlled, responsive to the reference voltage, and is not a function of the pulsed current through the LED string.

Preferably the operation of the plurality of voltage sources and the PWM controller are synchronized.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

FIG. 1 illustrates a high level schematic diagram of an embodiment 10 of a plurality of voltage sources comprising a plurality of DC/DC converters, each of the DC/DC converters receiving a PWM control responsive the pulsed constant current flow in a respective LED string in accordance with a principle of the invention. Embodiment 10 comprises: a first, second and third DC/DC converter 20 each comprising a PWM driver 30; a fourth DC/DC converter 40 supplying power for an LCD control circuit; a clock 50; an AC source 60; a full wave rectifier 70; and an AC/DC converter 80. Preferably, each of first, second and third DC/DC converter 20 are constituted of a wide range DC/DC converter.

AC source 60 is connected to full wave rectifier 70, and the output of full wave rectifier 70 is connected to the input of AC/DC converter 80. The output of AC/DC converter 80 is connected to each of first, second and third DC/DC converter 20, and is further connected to DC/DC converter 40. Clock 50 is arranged to synchronize the operation of each of first, second and third DC/DC converter 20, and DC/DC converter 40.

Figure 3:
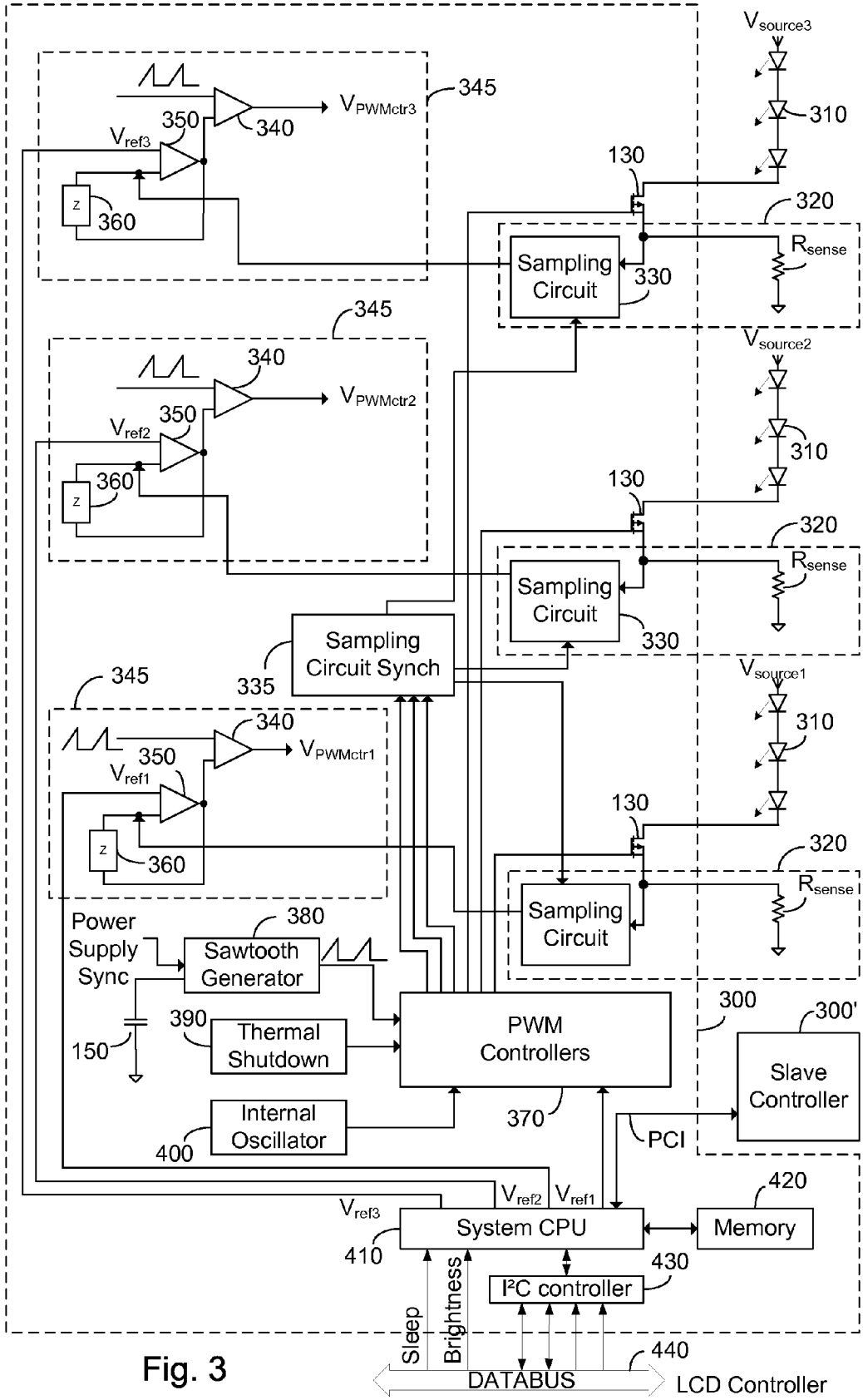
FIG. 3 illustrates a high level schematic diagram of an embodiment of a system comprising an LED controller operable to provide both PWM and AM control to a plurality of colored LED strings in accordance with a principle of the invention.

PWM driver 30 of first DC/DC converter 20 controls an output voltage, denoted $V_{source1}$, of first DC/DC converter 20 which as will be explained further hereinto below in relation to FIG. 3 is fed to a first LED string. PWM driver 30 of first DC/DC converter 20 further receives a PWM control feedback, labeled $V_{PWMctr1}$, which as will be explained further hereinto below in relation to FIG. 3, provides a control PWM pulse to PWM driver 30 responsive to the current flow through the first LED string and a difference from a variable reference.

PWM driver 30 of second DC/DC converter 20 controls an output voltage, denoted $V_{source2}$, of second DC/DC converter 20 which as will be explained further hereinto below in relation to FIG. 3 is fed to a second LED string. PWM driver 30 of second DC/DC converter 20 further receives a PWM control feedback, labeled $V_{PWMctr2}$, which as will be explained further hereinto below in relation to FIG. 3, provides a control PWM pulse to PWM driver 30 responsive to the current flow through the second LED string and a difference from a variable reference.

PWM driver 30 of third DC/DC converter 20 controls an output voltage, denoted $V_{source3}$, of third DC/DC converter 20 which as will be explained further hereinto below in relation to FIG. 3 is fed to a third LED string. PWM driver 30 of third DC/DC converter 20 further receives a PWM control feedback, labeled $V_{PWMctr3}$, which as will be explained further hereinto below in relation to FIG. 3, provides a control PWM pulse to PWM driver 30 responsive to the current flow through the third LED string and a difference from a variable reference.

DC/DC converter 40, in cooperation with its associated PWM controller 30, provides a fixed voltage output, typically one or more of 5 volts and 3.3 volts, to drive the control circuitry. Preferably, the operation of PWM controller 30 of first, second and third wide range DC/DC converters 20 and PWM controller 30 of DC/DC converter 40 are synchronized with a timing output of clock 50. There is no requirement that all PWM controllers 30 be synchronized to operate at the same edge of the timing output of clock 50, and at least one PWM controller 30 of first, second and third wide range DC/DC converters 20 and PWM controller 30 of DC/DC converter 40 may be phase delayed without exceeding the scope of the invention. Such a phase delay may be advantageously used to reduce unwanted electromagnetic interference (EMI).

The invention is herein being described in relation to an embodiment having 3 LED strings, however this is not meant to be limiting in any way. Four or more LED strings, or a single white LED string, may be utilized without exceeding the scope of the invention. The term PWM controller is meant to include, without limitation, a resonance controller or other variably controllable voltage source.

Figure 2:
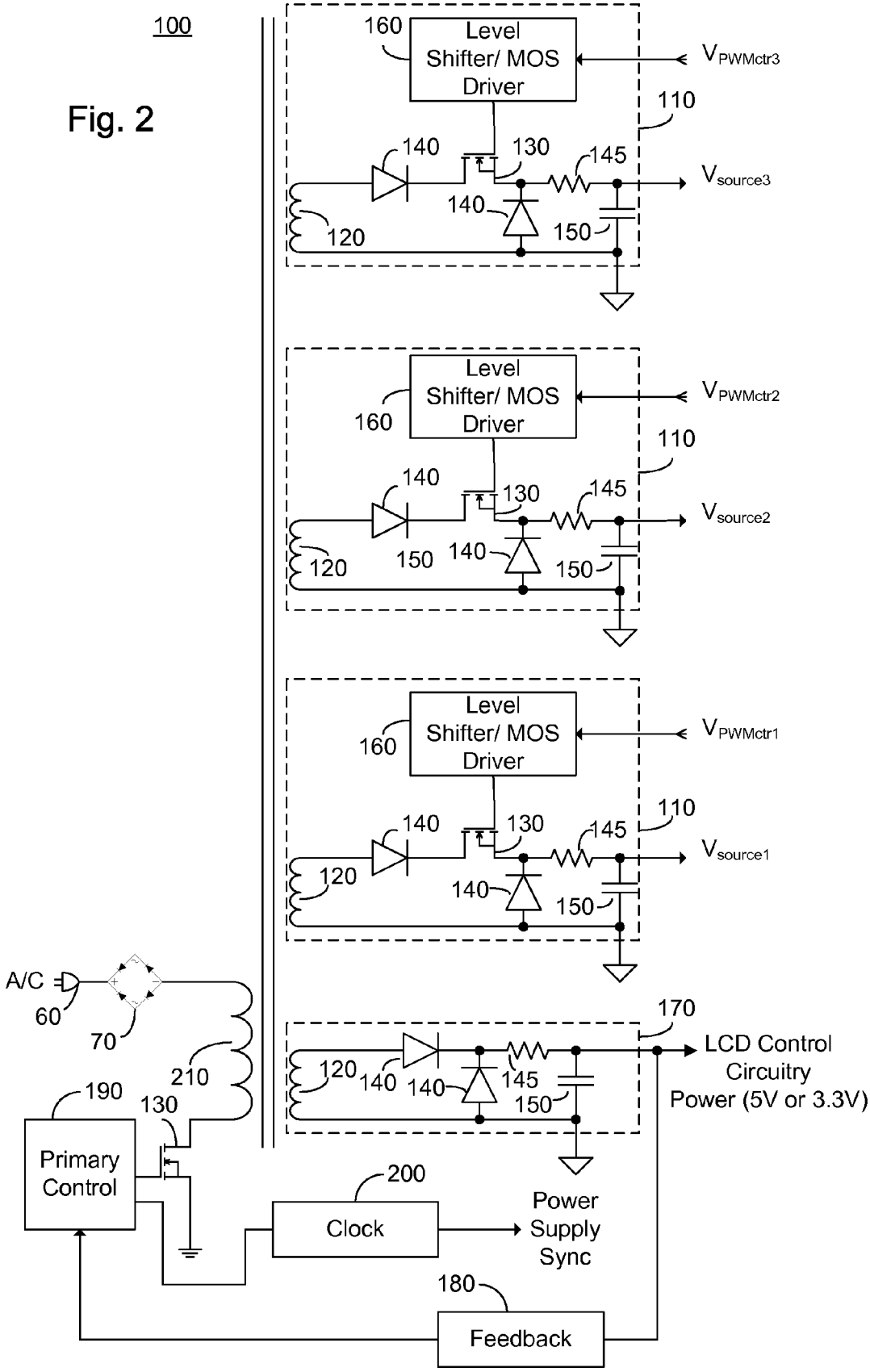
FIG. 2 illustrates a high level schematic diagram of an embodiment of a plurality of voltage sources constituted of secondary side post regulators, each of the secondary side post regulators receiving a PWM control responsive to the pulsed constant current flow in a respective LED string in accordance with a principle of the invention.

FIG. 2 illustrates a high level schematic diagram of an embodiment 100 of a plurality of voltage sources constituted of secondary side post regulators, each of the secondary side post regulators receiving a PWM control responsive to the pulsed constant current in a respective LED string in accordance with a principle of the invention. Embodiment 100 comprises: an AC source 60; a full wave rectifier 70; a primary winding 210; a primary PWM control 190; a clock 200; an electronically controlled switch 130; a first, second and third secondary side post regulator (SSPR) 110, each comprising a secondary winding 120, an electronically controlled switch 130, a first and second one way electronic valve 140, an impedance 145, a capacitor 150, and a level shifter and switch driver 160; a secondary side main path 170 comprising a secondary winding 120, a first and second one way electronic valve 140, an impedance 145 and a capacitor 150; and a feedback circuit 180.

AC source 60 is connected to full wave rectifier 70, the output of full wave rectifier 70 is connected to a first end of primary winding 210, and the second end of primary winding 210 is connected to one end of electronically controlled switch 130. The gate of electronically controlled switch 130 is connected to primary PWM control 190, and the second end of electronically controlled switch 130 is connected to ground. A timing output of clock 200 is preferably connected to primary PWM control 190 and a second timing output provides synchronization to the PWM controller of the LED strings as will be described further hereinto below in relation to FIG. 3. A first end of secondary winding 120 of secondary main path 170 is connected to the anode of first one way electronic valve 140, and the cathode of first one way electronic valve 140 is connected to the cathode of second one way electronic valve 140 and through impedance 145 acts as an output providing a fixed voltage, typically one or more of 5 volts and 3.3 volts, to drive the control circuitry. A first end of capacitor 150 of secondary main path 170 is connected to the output, and a second end is connected to a common point, as well as to the second end of secondary winding 120 of secondary main path 170 and to the anode of second one way electronic valve 140. The output of secondary main path 170 is further connected as an input to feedback circuit 180. The output of feedback circuit 180 is connected as a control input to primary PWM control 190. In an exemplary embodiment feedback circuit 180 exhibits isolation between input and output, preferably the isolation being supplied via the use of an opto-isolator.

A first end of secondary winding 120 of first SSPR 110 is connected to the anode of first one way electronic valve 140 of first SSPR 110, and the cathode of first one way electronic valve 140 is connected a first end of electronically controlled switch 130 of first SSPR 110. The gate of electronically controlled switch 130 is connected to the output of level shift and switch driver 160 of first SSPR 110, and the second end of electronically controlled switch 130 is connected to the cathode of second one way electronic valve 140 and through impedance 145 to act as an output, denoted $V_{source1}$, which as will be explained further hereinto below in relation to FIG. 3 is fed to a first LED string. Output $V_{source1}$ is further connected to a first end of capacitor 150 of first SSPR 110, and a second end of capacitor 150 is connected to a common point, to the second end of secondary winding 120 of first SSPR 110 and to the anode of second one way electronic valve 140. Level shifter and switch driver 160 receives a PWM control, labeled $V_{PWMctr1}$, which as will be explained further hereinto below in relation to FIG. 3, provides a PWM control signal to level shifter and switch driver 160 responsive to the pulsed constant current through the first LED string and a variable control voltage, and drives electronically controlled switch 130 to adjust the output voltage $V_{source1}$ as required to accommodate the forward voltage drop across the first LED string.

A first end of secondary winding 120 of second SSPR 110 is connected to the anode first one way electronic valve 140 of second SSPR 110, and the cathode of first one way electronic valve 140 is connected a first end of electronically controlled switch 130 of second SSPR 110. The gate of electronically controlled switch 130 is connected to the output of level shift and switch driver 160 of second SSPR 110, and the second end of electronically controlled switch 130 is connected to the cathode of second one way electronic valve 140 and through impedance 145 to act as an output, denoted $V_{source2}$, which as will be explained further hereinto below in relation to FIG. 3 is fed to a second LED string. Output $V_{source2}$ is further connected to a first end of capacitor 150 of second SSPR 110, and a second end of capacitor 150 is connected to a common point, to the second end of secondary winding 120 of second SSPR 110 and to the anode of second one way electronic valve 140. Level shifter and switch driver 160 receives a PWM control, labeled $V_{PWMctr2}$, which as will be explained further hereinto below in relation to FIG. 3, provides a PWM control signal to level shifter and switch driver 160 responsive to the pulsed constant current through the second LED string and a variable control voltage, and drives electronically controlled switch 130 to adjust the output voltage $V_{source2}$ as required to accommodate the forward voltage drop across the second LED string.

A first end of secondary winding 120 of third SSPR 110 is connected to the anode of first one way electronic valve 140 of third SSPR 110, and the cathode of first one way electronic valve 140 is connected a first end of electronically controlled switch 130 of third SSPR 110. The gate of electronically controlled switch 130 is connected to the output of level shift and switch driver 160 of third SSPR 110, and the second end of electronically controlled switch 130 is connected to the cathode of second one way electronic valve 140 and through impedance 145 to act as an output, denoted $V_{source3}$, which as will be explained further hereinto below in relation to FIG. 3 is fed to a third LED string. Output $V_{source3}$ is further connected to a first end of capacitor 150 of third SSPR 110, and a second end of capacitor 150 is connected to a common point, to the second end of secondary winding 120 of third SSPR 110 and to the anode of second one way electronic valve 140. Level shifter and switch driver 160 receives a PWM control, labeled $V_{PWMctr3}$, which as will be explained further hereinto below in relation to FIG. 3, provides a PWM control signal to level shifter and switch driver 160 responsive to the pulsed constant current through the third LED string and a variable control voltage, and drives electronically controlled switch 130 to adjust the output voltage $V_{source3}$ as required to accommodate the forward voltage drop across the third LED string.

The invention is herein being described in relation to an embodiment having 3 LED strings, however this is not meant to be limiting in any way. Four or more LED strings, or a plurality of white LED strings, may be utilized without exceeding the scope of the invention. The term PWM controller is meant to include, without limitation, a resonance controller or other variably controllable voltage source.

FIG. 3 illustrates a high level schematic diagram of an embodiment of a system comprising an LED controller operable to provide both PWM and AM control to a plurality of colored LED strings in accordance with a principle of the invention. The system of FIG. 3 comprises: a LED mater controller 300; an LED slave controller 300'; a first, second and third LED string 310; a first, second and third current sense element, illustrated without limitation as a resistor $R_{sense}$; a data bus 440 for connection with an LCD controller (not shown) and an SPI bus for connection between LED master controller 300 and one or more LED slave controllers 300'. For clarity only one LED slave controller 300' is shown, however this is not meant to be limiting in any way, and two or more LED slave controllers 300' may be connected without exceeding the scope of the invention. Sense element $R_{sense}$ may be replaced with a sense FET or other current sensing means known to those skilled in the art without exceeding the scope of the invention.

LED mater controller 300 comprises: a first, second and third electronically controlled switch 130; a first second and third synchronized sampling circuit 330; a sampling circuit synchronizer 335; a first second and third comparator 340; a first, second and third comparator 350; a first, second and third impedance 360; a saw-tooth generator 380; a thermal shutdown functionality 390; an internal isolator 400; a system CPU 410; a memory 420; and an $I^2C$ controller 430. PWM controller 370 is illustrated as a single PWM controller however this is not meant to be limiting in any way, and is for the sake of ease of illustration only. In an exemplary embodiment PWM controller 370 comprises a plurality of PWM controller, each individual PWM controller begin associated with one of first, second and third LED strings 310, respectively.

Functionally, LED master controller 300 comprises: a first, a second and a third synchronized sampler 320; and a first, second and third feedback circuit 345. Each of first, second and third synchronized sampler 320 comprises a respective sense element $R_{sense}$ and a synchronized sampling circuit 330. Each of first, second and third feedback circuit 345 comprises a respective comparator 340, a respective comparator 350, and a respective impedance 360. In one embodiment, synchronized sampling circuit 330 comprises a sample and hold circuit, and in another embodiment synchronized sampling circuit 330 comprises an analog to digital (A/D) converter. Each synchronized sampling circuit 330 is responsive to an output of sampling circuit synchronizer 335. There is no requirement that first, second and third synchronized samplers 320 be synchronized with each other, and sampling circuit synchronizer 335 is responsive to PWM controller 370, respectively for each LED string 310, in consonance with, and preferably delayed to allow for settling of, the operation of the respective electronically controlled switch 130 to pulse current through the respective LED string 310.

A first end of first LED string 310 is connected to $V_{source1}$, as described above in relation to FIGS. 1 and 2, and a second end of first LED string 310 is connected to a first end of first electronically controlled switch 130. A second end of first electronically controlled switch 130 is connected to a first end of first sense element $R_{sense}$ and a second end of first sense element $R_{sense}$ is connected to a common point. The gate of first electronically controlled switch 130 is connected to a respective output of PWM controller 370. The first end of first sense element $R_{sense}$, which exhibits a voltage pulse representative of the pulsed current flowing through first LED string 310, is connected to the input of first synchronized sampling circuit 330. The output of first synchronized sampling circuit 330 is connected to a first input of first comparator 350 and to a first end of first impedance 360, and the control input of first synchronized sampling circuit 330 is connected to an output of sampling circuit synchronizer 335. A second input of first comparator 350, denoted $V_{ref1}$, is connected to a first analog output of system CPU 410. The output of first comparator 350 is connected to the second end of first impedance 360 and to the first input of first comparator 340. The second input of first comparator 340 is connected to the output of saw-tooth generator 380 and the output of first comparator 340, denoted $V_{PWMctr1}$, is connected to first PWM driver 30 of FIG. 1 or level shift and switch driver 160 of FIG. 2.

A first end of second LED string 310 is connected to $V_{source2}$, as described above in relation to FIGS. 1 and 2, and a second end of second LED string 310 is connected to a first end of second electronically controlled switch 130. A second end of second electronically controlled switch 130 is connected to a first end of second sense element $R_{sense}$ and a second end of second sense element $R_{sense}$ is connected to a common point. The gate of second electronically controlled switch 130 is connected to a respective output of PWM controller 370. The first end of second sense element $R_{sense}$, which exhibits a voltage pulse representative of the pulsed current flowing through second LED string 310, is connected to the input of second synchronized sampling circuit 330. The output of second synchronized sampling circuit 330 is connected to a first input of second comparator 350 and to a first end of second impedance 360, and the control input of second synchronized sampling circuit 330 is connected to an output of sampling circuit synchronizer 335. A second input of second comparator 350, denoted $V_{ref2}$, is connected to a second analog output of system CPU 410. The output of second comparator 350 is connected to the second end of second impedance 360 and to the first input of second comparator 340. The second input of second comparator 340 is connected to the output of saw-tooth generator 380 and the output of second comparator 340, denoted $V_{PWMctr2}$, is connected to second PWM driver 30 of FIG. 1 or level shift and switch driver 160 of FIG. 2.

A first end of third LED string 310 is connected to $V_{source3}$, as described above in relation to FIGS. 1 and 2, and a second end of third LED string 310 is connected to a first end of third electronically controlled switch 130. A second end of third electronically controlled switch 130 is connected to a first end of third sense element $R_{sense}$ and a second end of third sense element $R_{sense}$ is connected to a common point. The first end of third sense element $R_{sense}$, which exhibits a voltage pulse representative of the pulsed current flowing through third LED string 310, is connected to the input of third synchronized sampling circuit 330. The gate of third electronically controlled switch 130 is connected to a respective output of PWM controller 370. The output of third synchronized sampling circuit 330 is connected to a first input of third comparator 350 and to a first end of third impedance 360, and the control input of second synchronized sampling circuit 330 is connected to an output of sampling circuit synchronizer 335. A second input of third comparator 350, denoted $V_{ref3}$, is connected to a third analog output of system CPU 410. The output of third comparator 350 is connected to the second end of third impedance 360 and to the first input of third comparator 340. The second input of third comparator 340 is connected to the output of saw-tooth generator 380 and the output of third comparator 340, denoted $V_{PWMctr3}$, is connected to third PWM driver 30 of FIG. 1 or level shift and switch driver 160 of FIG. 2.

PWM controller 370 is connected to an output of system CPU 410, an output of saw-tooth generator 380, an output of thermal shutdown functionality 390 and an output of internal oscillator 400. Sampling circuit synchronizer 335 is connected to timing outputs of PWM controller 370, preferably a separate timing output for each associated electronically controlled switch 310. Saw-tooth generator 380 is synchronized with the LCD matrix control via a sync input, and preferably outputs a synchronization signal for clocks 50, 200 of FIGS. 1, 2 respectively. Saw-tooth generator 380 further exhibits a connection to a common point via capacitor 150. Memory 420 is connected to system CPU 410, and is operational to store factory default settings as will be described further hereinto below. $I^2C$ controller 410 provides a standard connection interface between data bus 440 and system CPU 410. The use of an $I^2C$ controller is by way of illustration, and is not meant to be limiting in any way. A UART, any data bus connection, or a direct connection may be utilized in place of the $I^2C$ controller connection without exceeding the scope of the invention. System CPU 410 is shown as exhibiting a direct connection to data bus 440 for sleep and brightness commands however these may be further connected via $I^2C$ controller 430 without exceeding the scope of the invention. An SPI connection, also known as a Serial Peripheral Interface, available from Motorola of Schaumberg, Ill., is shown connected system CPU 410 of LED master controller 300 to LED slave controller 300', however this is not meant to be limiting in any way. Any connection, including without limitation an $I^2C$ bus, may be utilized without exceeding the scope of the invention.

System CPU 410 is connected to PWM controller 370, and further performs color management functionality. In particular, in one embodiment system CPU 410, responsive to a color sensor input (not shown), varies the PWM duty cycle of respective LED strings 310 to maintain an appropriate white point.

The above has been described in an embodiment in which a single LED string 310 is connected to each power source, however this is not meant to be limiting in any way. A plurality of LED strings may be connected in parallel to a single power source without exceeding the scope of the invention. In one such embodiment, feedback circuit 345 inputs a representation of a sum of the currents.

In operation, PWM controllers 370 are operational to enable each of first, second and third LED string 310 via the gate input of first, second and third electronically controlled switch 130, respectively. The current flowing through first, second and third LED string 310, respectively, is sensed by respective current sense element $R_{sense}$, and the sensed current is sampled during the time current is flowing by respective synchronized sampling circuit 330. Sampling circuit synchronizer 335 is operable to ensure that the sensed current is sampled when current flow is enabled by the respective electronically controlled switch 130, and preferably incorporates a delay to ensure that the sensed current is stable prior to sampling. The combination of current sense element $R_{sense}$ and synchronized sampling circuit 330, responsive to sampling circuit synchronizer 335, represents an embodiment of synchronized sampler 320.

PWM controllers 370 may have their pulse width modulated so as to individually, or alternatively as a group, modulate the luminance of first, second and third LED strings 310. The synchronized sampled value output from the respective synchronized sampling circuit 330, is compared with the respective variable reference voltage, $V_{ref}$, output by a respective analog output of system CPU 410, thus variably setting the amplitude. Any differential is amplified by the respective comparator 350, and the compared signal is fed back, gated by the saw-tooth waveform, via the respective comparator 340 so as to generate a pulse width modulated control for SSPR 110 of FIG. 2 or for PWM driver 30 of DC/DC converter 20 of FIG. 1, respectively. The combination of the respective comparator 340, 350 represents an embodiment of feedback circuit 345.

Thus, a representative of the current flowing through a respective LED string, when the respective electronically controlled switch 130 is in the on state thereby enabling current flow, is synchronously sampled, and the sample is compared with a variable voltage setting output of system CPU 410, respectively $V_{ref1}$, $V_{ref2}$, and $V_{ref3}$. The differential is used to generate the PWM control signal of the respective voltage driving voltage source, respectively $V_{PWMctr1}$, $V_{PWMctr2}$, $V_{PWMctr3}$ Thus a change in any one or more of $V_{ref1}$, $V_{ref2}$, and $V_{ref3}$ functions to change the AM of the respective LED string 310, while the respective voltage source $V_{source1}$, $V_{source2}$ and $V_{source3}$ may be controlled to have minimal excess voltage. Such a minimal excess voltage reduces power dissipation across the respective electronically controlled switch 310.

An overall change in brightness, while maintaining the balance between $V_{source1}$, $V_{source2}$ and $V_{source3}$, is effected by modifying the duty cycle of the respective of PWM controllers 370. Additionally, and further advantageously, system CPU 410 is operable to prevent a total shut off of LED string 310 during the off part of the pulse output of PWM controller 370 by controlling the gate of first, second and third electronically controlled switch 130, respectively.

The white point of an LCD monitor is a function of the pulsed constant current of the respective colored light strings. In one embodiment, during manufacturing the output of the LED strings are checked by a calibration sensor, and one of the LED strings are set to a maximum output, while the others are amplitude modulated until an appropriate white point is achieved. The setting, also known as the initial calibration white point setting, is uploaded to memory 420. System CPU 410 thus utilizes the initial calibration white point setting to maintain a white point balance. The initial calibration white point setting may cease to reflect a proper white point due to aging of the LED strings, or due temperature changes. In the event of temperature changes, each color LED string changes its output without being in consonance with changes of the other color LED strings. Preferably, memory 420 further provides the appropriate calibration offset for use by system CPU 410 to recover the white point for both aging and temperature variation as will be described further hereinto below.

In another embodiment, LEDs used in the production of LED strings 310 are first sorted, or binned, and memory 420 is loaded with an appropriate nominal white point setting. In the event that the LCD monitor is provided with a color sensor, as will be described further hereinto below, the white point is adjusted by system CPU 410 responsive to the output of the color sensor. Thus, CPU 410 exhibits color management functionality, and the color functionality is output to PWM controller 370.

System CPU 410 may further operate to control the operation of one or more LED slave controllers 300'. Thus, only a single memory 420 and system CPU 410 is required for a system with a plurality of LED controllers. It is to be understood that LED slave controllers 300' will require a controller in place of system CPU 410, however the controller can be smaller since the recalling functions, communication functions, and recalculation functions are handled in system CPU 410 of LED master controller 300.

Figure 4:
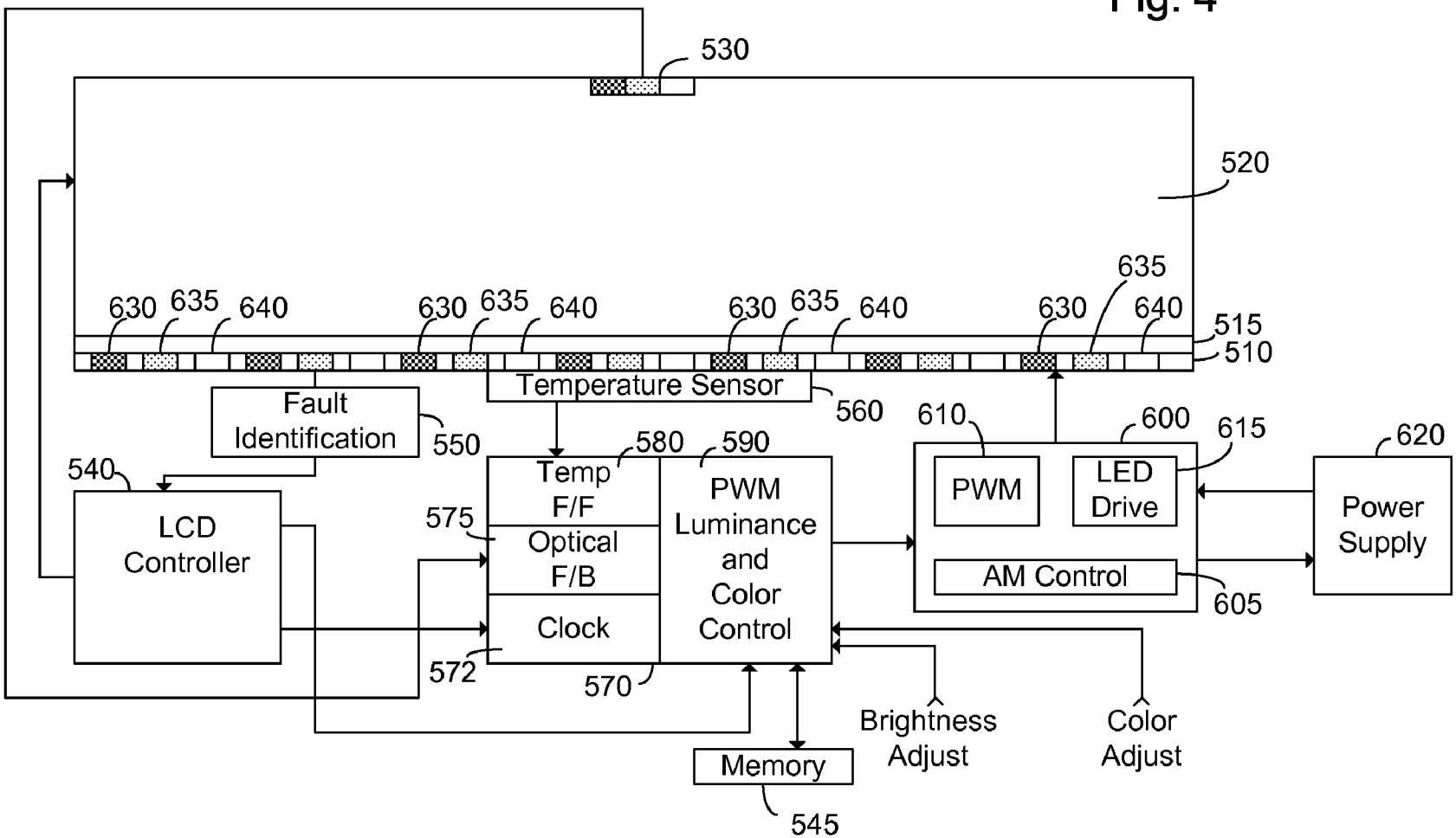
FIG. 4 illustrates a high level block diagram of an LCD monitor exhibiting colored LED strings and a single color sensor arranged to provide a feedback of required color correction and intensity in accordance with a principle of the invention.

FIG. 4 illustrates a high level block diagram of an LCD monitor 500 exhibiting colored high intensity LEDs and a single color sensor arranged to provide a feedback of required intensity and color correction. LCD monitor 500 comprises a plurality of LED strings 510 arranged along one edge or side of LCD monitor 500; a diffuser 515; an LCD active matrix 520; a color sensor 530; an LCD controller 540; a memory 545; a fault identification unit 550; a temperature sensor 560; an LCD backlight control unit 570 comprising an internal clock 572, an optical feedback unit 575, a temperature feed forward 580 and a PWM luminance and color control unit 590; a backlight driving unit 600 comprising amplitude modulation control 605, PWM control 610 and an LED driver 615; and a power supply 620. LED strings 510 comprise a plurality of first colored high intensity LEDs 630; second color high intensity LEDs 635; and third color high intensity LEDs 640. Diffuser 515 is placed so as to mix the colored output of first colored high intensity LEDs 630, second color high intensity LEDs 635 and third color high intensity LEDs 640 so as to produce a white back light for LCD active matrix 520.

LCD active matrix 520 is controlled by LCD controller 540. Fault identification unit 550 is preferably connected to measure the voltage drop across each first colored high intensity LEDs 630; second color high intensity LEDs 635; and third color high intensity LEDs 640.

LCD controller 540 provides a synchronizing signal for internal clock 572 and a control signal for PWM luminance and color control unit 590. PWM luminance and color control unit 590 is responsive to sleep mode and test mode instructions from LCD controller 540. In an exemplary embodiment, the sleep mode and test mode instructions are received via databus 440 of FIG. 3. Temperature feed forward 580 receives an input from temperature sensor 560 and is operable as described above to compensate for changes in luminance of each color due to temperature changes. Information for the compensation is retrieved from memory 545. Temperature feed forward 580 calculates the appropriate compensation for each color LED string 510, preferably via the use of an on-board look up table, and adjusts at least one of AM control 605 and PWM control 610.

Backlight driving unit 600 is connected to supply pulse width and amplitude modulated constant current drive for high intensity LEDs 630, 635 and 640, via LED driver 615 and to receive power from power supply 620. Power supply 620 further receives control information from backlight driving unit 600, as described above in relation to $V_{PWMctr1}$, $V_{PWMctr2}$, $V_{PWMctr3}$ Optical feedback 575 receives an input from color sensor 530 and is operable to respond to changes in both the luminance and white point. In one embodiment color sensor 530 comprises an XYZ sensor, whose output values closely track the tristimulus values of the human eye. In another embodiment an RGB sensor is used. Optical feedback 575 is operable to adjust at least one of AM control 650 and PWM control 610 to maintain a pre-determined white point. Additionally, aging of the high intensity LEDs is sensed and preferably compensated for by the feedback of color sensor 530.

PWM luminance and color control unit 590 further receives user input to adjust brightness and color, and is responsive to those inputs to modify at least one of AM control 605 and PWM control 610 of backlight driving unit 600.

Backlight driving unit 600 receives a control input from PWM luminance and control unit 590 and is operative to drive the plurality of LED strings 510 responsive to the control input via LED driver 615. Backlight driving unit 600 further receives power from power supply 620, which preferably supplies a separate constant current power for each color LED string of the plurality of LED strings 510. Power supply 620 exhibits adaptive regulation as described above in relation to FIGS. 1-3, to reduce system power dissipation since it is responsive to backlight driving unit 600 to modify its output so as to accommodate its output voltage to the voltage drop across the respective LED string 510.

Thus, the present embodiments enable a secondary side post regulator arrangement for a plurality of LED strings. For each secondary winding of the secondary side post regulator, a first electronically controlled switch is provided arranged to control the power output, and a LED string is connected thereto. A second electronically controlled switch is further connected in series with the LED string, arranged to receive a PWM signal, thereby pulsing current through the LED string. A current sensing element is further provided outputting a voltage representation of the current through the LED string, and a synchronized sampler is provided arranged to sample the voltage representation during the on period of the second electronically controlled switch. The sampled and held voltage representation is compared with a reference signal and fed back to control the first electronically controlled switch. Thus, the voltage output associated with each secondary winding is controlled, responsive to the reference voltage, and is not a function of the pulsed current through the LED string.

Preferably the operation of the plurality of voltage sources and the PWM controller are synchronized.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable subcombination.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

It will be appreciated by persons skilled in the art that the present invention is not limited to what has been particularly shown and described hereinabove. Rather the scope of the present invention is defined by the appended claims and includes both combinations and subcombinations of the various features described hereinabove as well as variations and modifications thereof which would occur to persons skilled in the art upon reading the foregoing description and which are not in the prior art.

We claim:

1. A powering arrangement comprising:

a primary side pulse width modulation control circuit;

a primary side electronically controlled switch responsive to an output of said primary side pulse width modulation control circuit;

a primary side feedback circuit;

a transformer exhibiting a primary winding and a plurality of secondary windings coupled to said primary winding, the primary winding connected in series with said primary side electronically controlled switch so as to be switchably coupled across a source of electrical power, wherein electrical power from the source of electrical power is alternately passed through said primary winding and prevented from passing through said primary winding responsive to the respective state of said primary side electronically controlled switch;

a plurality of secondary side regulators, each associated with a particular one of the secondary windings and each arranged to control power output from the associated respective secondary winding to a respective load, each of said plurality of secondary side regulators comprising an electronically controlled switch arranged in series with the associated secondary winding;

a plurality of secondary side electronically controlled switches, each of said plurality of secondary side electronically controlled switches arranged in series with the output of a particular one of said plurality of secondary side regulators to pulseably enable the flow of current through the respective load;

a plurality of synchronized samplers, each of said plurality of synchronized samplers associated with a particular one of said plurality of secondary side electronically controlled switches and arranged to sample said pulseably enabled current flow and output a sampled representation; and a plurality of secondary side feedback circuits each associated with a particular one of said plurality of synchronized samplers, each of said plurality of secondary side feedback circuits configured for control of the associated particular secondary side regulator responsive to said respective sampled representation, wherein said primary side feedback circuit is arranged to feedback an output from one of said plurality of secondary windings for which a secondary side regulator is not supplied to a control input of said primary side pulse width modulation control circuit.

2. A powering arrangement according to claim 1, wherein each of said plurality of secondary side feedback circuits comprises a comparing circuit arranged to:

receive said associated reference voltage and said sampled representation; and output a compared signal responsive to the difference between said received reference voltage and said received sampled representation, said control of the associated particular secondary side regulator being responsive to said compared signal.

3. A powering arrangement according to claim 1, further comprising a plurality of secondary side pulse width modulation controllers, each of said plurality of secondary side electronically controlled switches pulseably enabling said current flow responsive to a particular one of said plurality of secondary side pulse width modulation controllers.

4. A powering arrangement according to claim 1, further comprising a plurality of reference voltages, each of said plurality of secondary side feedback circuits being further associated with, and responsive to, a particular one of said plurality of reference voltages, said control of the associated particular secondary side regulator being a function of said respective reference voltage.

5. A powering arrangement according to claim 4, wherein said plurality of reference voltages are variable.

6. A powering arrangement comprising:

a plurality of DC/DC converters receiving power from a common power source, each of said plurality of DC/DC converters comprising a first electronically controlled switch;

a plurality of second electronically controlled switches, each of said second plurality of electronically controlled switches associated with, and arranged in series with, the output of a particular one of said plurality of DC/DC converters and arranged to pulseably enable the flow of current sourced from said particular DC/DC converter through a respective load;

a plurality of synchronized samplers, each of said plurality of synchronized samplers associated with a particular one of said plurality of second electronically controlled switches and arranged to sample said pulseably enabled current flow and output a sampled representation;

a plurality of feedback circuits each associated with a particular one of said plurality of synchronized samplers, each of said plurality of feedback circuits arranged to control a respective one of said first electronically controlled switches responsive to said respective sampled representation; and a plurality of reference voltages, each of said plurality of feedback circuits being further associated with, and responsive to, a particular one of said plurality of reference voltages, wherein each of said plurality of feedback circuits comprises a comparing circuit arranged to:

receive said associated reference voltage and said sampled representation; and output a compared signal responsive to the difference between said received reference voltage and said received sampled representation, said control of said respective one of said first electronically controlled switch being responsive to said compared signal.

7. A powering arrangement according to claim 6, wherein said control of said respective one of said first electronically controlled switches thereby controls the output of the respective DC/DC converter.

8. A powering arrangement according to claim 6, wherein said plurality of reference voltages are variable.

9. A powering arrangement according to claim 6, wherein each of said plurality of DC/DC converters is arranged to power a light emitting diode (LED) string, the load being constituted of an LED string.

10. A powering arrangement according to claim 6, further comprising a plurality of pulse width modulation controllers, each of said second plurality of electronically controlled switches pulseably enabling said current flow responsive to a particular one of said plurality of pulse width modulation controllers.

11. A powering arrangement for a plurality of light emitting diode (LED) strings, said powering arrangement comprising:

a primary side pulse width modulation control circuit;

a primary side electronically controlled switch responsive to an output of said primary side pulse width modulation control circuit;

a primary side feedback circuit;

a transformer exhibiting a primary winding and a plurality of secondary windings coupled to said primary winding, the primary winding connected in series with said primary side electronically controlled switch so as to be switchably coupled across a source of electrical power, wherein electrical power from the source of electrical power is alternately passed through said primary winding and prevented from passing through said primary winding responsive to the respective state of said primary side electronically controlled switch;

a first plurality of secondary side electronically controlled switches, each of said first plurality of secondary side electronically controlled switches associated with a particular one of said plurality of secondary windings;

a plurality of LED strings, each of said plurality of LED strings associated with, and arranged to receive power from, a particular one of said plurality of secondary windings responsive to the respective first secondary side electronically controlled switch;

a second plurality of secondary side electronically controlled switches, each of said second plurality of secondary side electronically controlled switches arranged in series with a particular one of said plurality of LED strings and arranged to pulseably enable the flow of current through said particular LED string;

a plurality of synchronized samplers, each of said plurality of synchronized samplers in communication with a particular one of said plurality of LED strings and arranged to sample said pulseably enabled current flow and output a sampled representation; and a plurality of secondary side feedback circuits each associated with a particular one of said plurality of synchronized samplers, each of said plurality of secondary side feedback circuits arranged to control a respective one of said first secondary side electronically controlled switches responsive to said respective sampled representation, wherein said primary side feedback circuit is arranged to feedback an output from one of said plurality of secondary windings to a control input of said primary side pulse width modulation control circuit.

12. A powering arrangement according to claim 11, wherein said control of said respective one of said first secondary side electronically controlled switches controls the voltage of said power received by the respective LED string.

13. A powering arrangement according to claim 11, further comprising a plurality of one way electronic valves, each of said plurality of one way electronic valves being associated with a particular one of said plurality of secondary windings and in communication with the respective first secondary side electronically controlled switch.

14. A powering arrangement according to claim 11, further comprising a plurality of secondary side pulse width modulation controllers, each of said second plurality of secondary side electronically controlled switches pulseably enabling said current flow responsive to a particular one of said plurality of secondary side pulse width modulation controllers.

15. A powering arrangement according to claim 14, further comprising a control unit, each of said pulse width modulation controllers being responsive to said control unit to modify the luminance of each of plurality of LED strings.

16. A powering arrangement according to claim 14, further comprising a saw tooth voltage source, each of said plurality of secondary side pulse width modulation controllers being responsive to said saw tooth voltage source.

17. A powering arrangement according to claim 16, wherein each of said plurality of secondary side feedback circuits is further responsive to said saw tooth voltage source.

18. A powering arrangement according to claim 11, wherein at least one of said plurality of synchronized samplers comprises a current sensing element arranged to provide a voltage representation of the current through the particular one of the plurality of LED strings.

19. A powering arrangement according to claim 18, wherein said current sensing element comprises one of a resistor and a field effect transistor.

20. A powering arrangement according to claim 18, wherein said at least one of said plurality of synchronized samplers comprises a synchronized sampling circuit in communication with said current sensing element and arranged to sample said voltage representation during said pulseably enabled current flow.

21. A powering arrangement according to claim 20, wherein said synchronized sampling circuit comprises one of a sample and hold circuit and an analog to digital converter.

22. A powering arrangement according to claim 11, further comprising a plurality of reference voltages, each of said plurality of secondary side feedback circuits being further associated with, and responsive to, a particular one of said plurality of reference voltages, said control of said respective one of said first secondary side electronically controlled switches being a function of said respective reference voltage.

23. A powering arrangement according to claim 22, wherein said plurality of reference voltages are variable.

24. A powering arrangement according to claim 22, wherein each of said plurality of secondary side feedback circuits comprises a comparing circuit arranged to:

receive said associated reference voltage and said sampled representation; and output a compared signal responsive to the difference between said received reference voltage and said received sampled representation, said control of said respective one of said first secondary side electronically controlled switch being responsive to said compared signal.

25. A powering arrangement according to claim 22, further comprising a control unit arranged to set the plurality of reference voltages so as to bring each of the plurality of LED strings to a pre-determined luminance.

26. A powering arrangement according to claim 22, further comprising a control unit arranged to set the plurality of reference voltages so as to bring each of the plurality of LED strings to produce a pre-determined white point.

27. A powering arrangement according to claim 26, further comprising a memory associated with said control unit, said memory having stored thereon an initial calibration white point setting, said plurality of reference voltages being responsive to said stored initial calibration white point setting.

28. A powering arrangement according to claim 26, wherein said control unit further comprises a means for receiving a temperature input, said control unit arranged to modify at least one of the plurality of reference voltages responsive to the received temperature input.

29. A powering arrangement according to claim 26, wherein said control unit further comprises a means for receiving a color sensor input, said control unit arranged being to modify at least one of the plurality of reference voltages responsive to the received color sensor input so as to maintain said predetermined white point.

30. A method of powering for a plurality of light emitting diode (LED) strings, said method comprising:

providing a transformer comprising a primary winding and a plurality of secondary windings;

providing a primary side controller, said provided primary side controller arranged to switchably control electrical power through the primary winding of the provided transformer;

providing a plurality of secondary side controllers, the plurality of secondary side controllers less in number than the plurality of secondary windings;

providing a first plurality of secondary side electronically controlled switches, each associated with a particular secondary winding of the transformer and responsive to the output of a particular one of the provided plurality of secondary side controllers;

providing the plurality of LED strings, each of the provided plurality of LED strings associated with each of said provided secondary side controllers;

providing a second plurality of secondary side electronically controlled switches each arranged in series with a particular one of the provided LED strings;

pulseably enabling current flow through each of said associated provided LED strings by controlling the respective one of the provided second plurality of secondary side electronically controlled switches;

sampling said pulseably enabled current flow through each of said provided LED strings during said pulseably enabled current flow;

feeding back a function of each of said sampled pulseably enabled current flows to said associated provided secondary side controller; and controlling said provided primary side controller responsive to a particular secondary winding of the transformer for which no secondary side controller is provided.

31. A method according to claim 30, further comprising:

receiving a reference voltage, said fed back function responsive to said received reference voltage.

32. A method according to claim 31, wherein said reference voltage is variable.

33. A method according to claim 30, wherein said feeding back a function comprises:

receiving a reference voltage for each of said provided LED strings;

comparing said received reference voltage of each of said provided LED stings with said sampled pulseably enabled current flow of the respective provide LED string; and outputting a comparing signal for each of said provided LED strings responsive to the difference between said received reference voltage and said sampled pulseably enabled current flow.

* * * * *